United States Patent [19]

Sakuma

[11] Patent Number: 4,755,260

[45] Date of Patent: Jul. 5, 1988

[54] METHOD FOR PRODUCING FELT FOR PAPER MAKING

[75] Inventor: Norio Sakuma, Tokyo, Japan

[73] Assignee: Ichikawa Woolen Textile Co., Ltd., Tokyo, Japan

[21] Appl. No.: 904,952

[22] Filed: Sep. 5, 1986

[30] Foreign Application Priority Data

Sep. 13, 1985 [JP] Japan ..... 60-202959

[51] Int. Cl.[4] ..... D21F 7/10; D21F 3/00

[52] U.S. Cl. ..... 162/199; 28/110; 139/383/A; 162/200; 162/273; 162/358; 162/DIG. 1; 428/234; 428/300

[58] Field of Search ..... 162/199, 348, DIG. 1, 162/358, 273; 28/141, 142, 110; 139/383 A, 383 AA; 156/148, 159, 258, 304.1, 304.3–304.7; 428/300, 222, 223, 234

[56] References Cited

U.S. PATENT DOCUMENTS 4,601,785 7/1986 Lilja et al. ..... 162/199

FOREIGN PATENT DOCUMENTS 55358 2/1982 Japan .

*Primary Examiner*—S. Leon Bashore
*Assistant Examiner*—K. Hastings
*Attorney, Agent, or Firm*—Dann, Dorfman, Herrell & Skillman

[57] ABSTRACT

A papermaker's felt having an elongated base fabric, at least one batt layer, and means to interconnect the opposite longitudinal ends of the base fabric to make an endless felt. The endless felt is made by providing seaming loops on opposite longitudinal ends of the base fabric and bringing the loops into interdigitated engagement on the papter making machine; introducing a core element into the common bight of said loops to connect them; and finally needling the batt layer so that the abutting ends thereof (which abut each other at right angles to the longitudinal direction and obliquely to the thickness direction) are engaged without any opening between them. Marking the paper on the felt is avoided by specially preparing the felt before putting it on the machine, by posiitioning said seaming loops in longitudinally spaced-apart relationship and inserting shape-retaining wires into the bights of said loops; and needling a batt layer on at least one side of the fabric and between said spaced-apart loops to make the batt layer endless; cutting said batt layer widthwise adjacent the loops of the fabric into flat form; removing the shape-retaining wires from the bights of the seaming loops at the opposited ends and temporarily connecting to loops and cutting away the extra fibrous batt so that the cut ends of the batt may abut one another obliquely to the thickness direction of the batt.

7 Claims, 3 Drawing Sheets

METHOD FOR PRODUCING FELT FOR PAPER MAKING

FIELD OF THE INVENTION

This invention relates to a method for producing a papermaker's felt so that it may be connected endlessly on paper-making machines.

BACKGROUND OF THE INVENTION

In the past, the felt of this kind is obtained, as disclosed for example in Japanese Utility Model Publication No. 55358/1982, by providing seaming loops on opposite longitudinal ends of a base fabric; engaging the seaming loops in interdigitated relation at the opposite ends and introducing a pintle wire or other core element through a common bight thereof to connect the loops and form an endless belt; forming batt layer(s) on one or both sides of the fabric by needling; and removing the core element and the cutting the batt layer widthwise into a flat form. When the loops are thereafter interdigitated and connected to form the endless felt on the paper machine, the cut ends of the batt layer are made to abut each other. However, in the felt produced by the above-described method, the tension which is continuously applied to the seaming loops on the paper machine deforms the loops, and there possibly forms a slight clearance between the abutting portions of the cut ends of the batt layer, which leads to formation of a so-called seam mark on the wet paper formed on the felt.

OBJECT OF THE INVENTION

This invention overcomes the above-described problem, and it is an object of the invention to provide a felt which avoids any opening between the cut ends of the batt layer on the paper machine.

SUMMARY OF THE INVENTION

For achieving the aforementioned object, the present invention is featured by providing seaming loops on opposite longitudinal ends of a base fabric; confronting the seaming loops in longitudinally-spaced relation with shape-retaining wires inserted into bights thereof and needling batt layer(s) on one or both sides of the fabric with or without previously temporarily connecting the confronted spaced-apart end portions by means of a suitable connecting member; cutting the batt layer widthwise at one end of the fabric into a flat form; and removing the shape-retaining wires from the bights of the seaming loops at the opposite ends to bring the loops into engagement with each other, introducing a core element into a common bight thereof to reconnect the loops in interdigitated relation and finally cutting or skiving the batt layer so that the ends thereof may abut each other at right angles to the longitudinal direction and obliquely to the thickness direction.

BRIEF DESCRIPTION OF THE DRAWINGS

The drawings show preferred embodiments of the present invention.

DETAILED DESCRIPTION OF THE PREFERRED EMBODIMENTS

Figure 1:
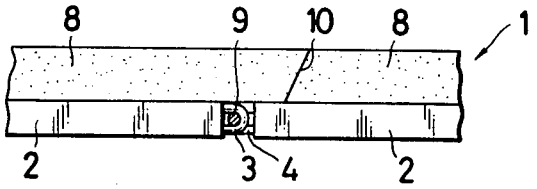
FIG. 1 is a longitudinal sectional view through the interconnected end portions of a papermaker's felt showing a core element in position for connecting the end portions.

In the following, this invention will be described in connection with embodiments shown in the drawings.

Figure 2:
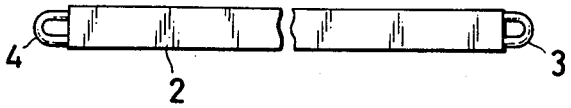
FIG. 2 is a fragmentary elevational view of the base fabric with loops at its opposite ends.
Figure 3:
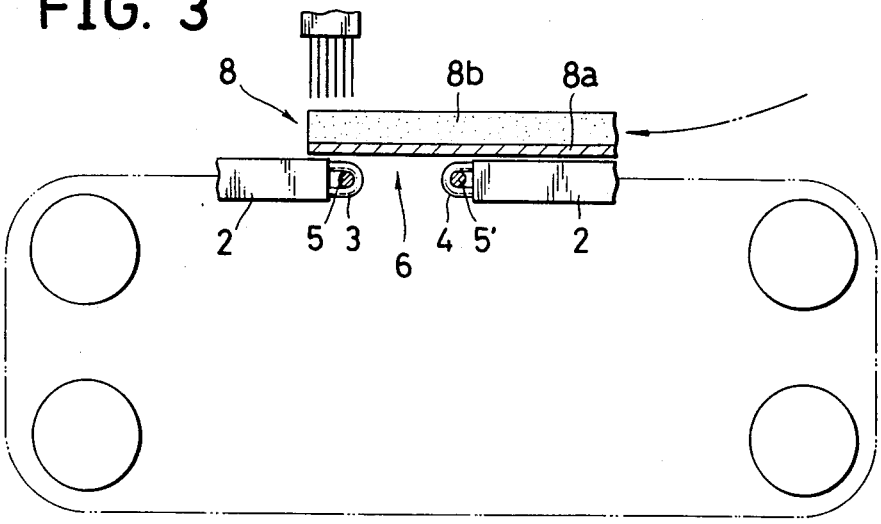
FIG. 3 is a schematic sectional view showing the end portion interconnected in spaced relation, as when needling starts.
Figure 4:
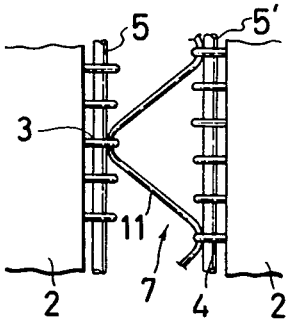
FIGS. 4 (*a*) and (*b*) illustrate alternate forms of devices performing the temporary connecting function of the method of the present invention.
Figure 4:
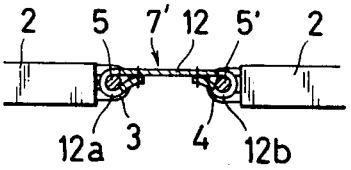
Figure 7:
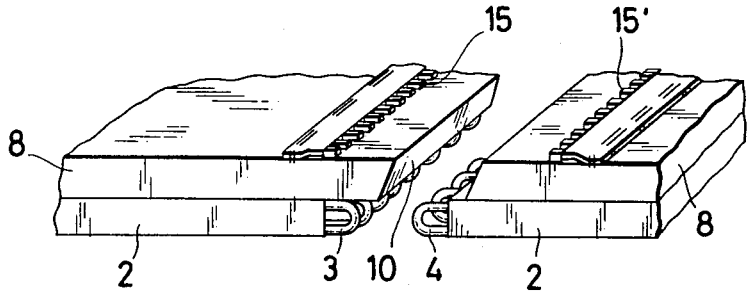
FIG. 7 is a schematic perspective view showing the mounting of connecting means such as fasteners.

FIG. 1 shows a felt 1 according to the present invention. The felt is produced by the method which comprises a first step of providing seaming loops 3, 4 on opposite longitudinal ends of a base fabric as shown in FIG. 2; a second step of confronting the seaming loops 3, 4 with shape-retaining wires 5, 5' inserted into bights thereof as shown in FIG. 3, and needling batt layer(s) on one (or both) side(s) of the fabric 2 with or without previously temporarily connecting the confronted portion by means of a suitable connecting member 7 or 7' as shown in FIG. 4(*a*) or 4(*b*); a third step of cutting the batt layer 8 widthwise at one end of the fabric 2 into a flat form; and a fourth step of removing the shape-retaining wires 5, 5' from the bights to bring the seaming loops 3, 4 at the opposite ends into interdigitated engagement with each other with their bights aligned to provide a common bight, introducing a core element in the form of a pintle 9 into said common bight to reconnect them and finally cutting an extra portion 80 of the end of the batt layer 8 to form an abutting portion 10 which is at right angles to the longitudinal direction and obliquely to the thickness direction, as shown in FIG. 7.

The base fabric 2 formed in the first step can be a woven fabric prepared as a single or a multiple ply fabric using, as warps and wefts, one or more kinds of strong yarns such as spun yarns, monfilament and multifilament of synthetic fibers, or the fabric may be of other textile construction, for example a laid-up fabric using special materials and formed by superposing warps and wefts and spot-welding points of intersection therebetween under thermal pressure. The longitudinal seaming loops 3, 4 at the opposite ends of the base fabric can be prepared by extending warps of the fabric 2 every one yarn (or plural yarns) from the end thereof and fold it back into the body to form a loop, or by using another suitable method, for example, cutting the fabric 2 so that the weft direction is lengthwise of the felt and the warps at the ends of the felt are pulled out of the body of the fabric to constitute ears or seaming loops.

The aforesaid second step is carried out on a needling machine. The insertion of the shape-retaining wires 5, 5' into the bights of the seaming loops 3, 4 is carried out so as not to deform or change the direction of the seaming loops during the needling or to permit blockage of the loops by the needled material of the batt layer. The wire-inserting operation is incorporated in the first step or is carried out in the process shifting from the first to the second step, as the case may be. The batt layer 8 comprises synthetic fibers or natural fibers, which are applied by 2 to 10 needling operations. In the initial needling, fibrous batt layers 8b are previously laminated on a thin fabric-like material 8a, which is subjected to preliminary needling, The needled layer is then secured to the fabric 2 by a final needling. This is preferable in retaining the strength of the felt because the frequency of needling the fabric 2 is decreased to minimize a damage to the base fabric. In finally needling the batt layer 8 to the fabric 2, the seaming loops 3, 4 are not directly connected but are confronted at spaced-apart intervals as shown in FIG. 3, which comprises a significant element of the present invention as will be apparent later. The spaced-apart ends in the portion 6 may be temporarily connected during needling, but need not be connected if properly guided in the needling operation. As for the temporary connecting method, a string 11 is bound into the confronted seaming loops 3, 4 in a zigzag form as shown in FIG. 4 (*a*). Alternatively, the loops may be connected by a sheet-like element 12 having holes 12a, 12b at opposite ends thereof through which seaming loops 3, 4 pass as shown in FIG. 4 (*b*). The loops 3, 4 are aligned with one another and connected by the shape-retaining wires 5, 5' threaded into the common bight of the seaming loops (in which case, the ends of the fabric sheet-like member may be folded back and stitched). It is to be noted of course that other connecting methods may be employed. In addition, when the confronting end portions at 6 are held by some means and covered by the ends of the batt layer 8 as shown in FIG. 3 to start needling from the covered portion, the confronting portion 6 may be subjected to needling without previous temporary connection. Preferably both ends of the batt layer are between the loops, so that these ends may be removed when the excess material is removed in the fourth step described hereinafter.

Figure 5:
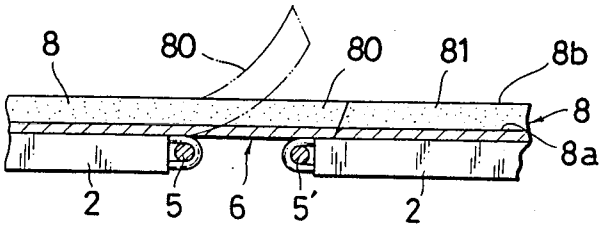
FIG. 5 is a schematic sectional view of the felt ends after the needling operation, illustrating the operation when the batt layer is cut.

In the third step, the endless batt layer 8 as formed on the needling machine is cut widthwise, preferably adjacent the loops at one of the ends of the base fabric 2, into flat form. This cutting operation is carried out by use of a suitable cutting means (irrespective of its being hand-operated or electrically-operated). The layer 8 may be cut roughly to some extent. Next, a flap portion 80 of the batt layer 8 being subjected to needling between the seaming loops 3, 4 is peeled off as shown by the broken contour lines in FIG. 5. In this case, the batt layer 8 has a sheet-like element 8a in contact with the base fabric and is easily peeled off since it is constructed such that a fibrous batt 8b is previously subjected to preliminary needling with respect to the sheet-like material 8a, to minimize damaging the flap. Thereafter, if the seaming loops 3, 4 have been temporarily connected by a suitable connecting member 7 or 7', the connecting member is removed from the needling machine.

Figure 6:
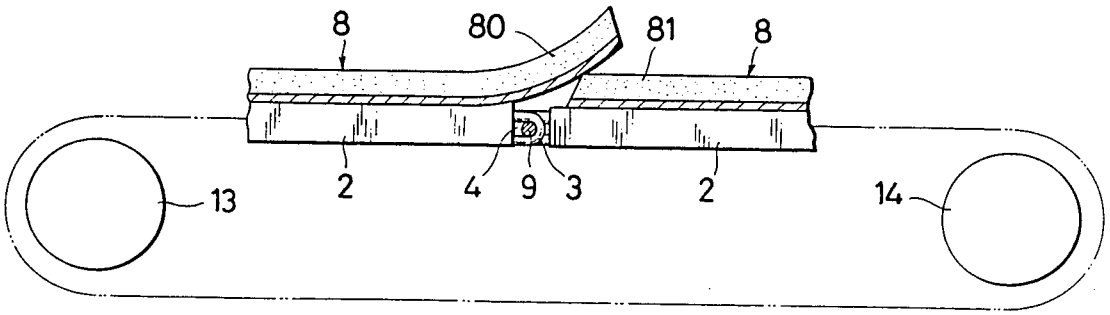
FIG. 6 is a schematic sectional view of the felt ends after their interdigitated connection, showing the state prior to the final cutting.

In the fourth step, the shape-retaining wires 5, 5' are pulled out of the seaming loops 3, 4 at the opposite ends of the flat body unloaded from the needling machine, the seaming loops 3, 4 are brought into re-engagement in interdigitated relation with each other between two shafts 13 and 14 spaced comparably to the shaft of a paper-making machine as shown in FIG. 6, into an endless form, and a core wire 9 is introduced into the common bight for reconnection thereof. In this case, since the seaming loops 3, 4 are retained in shape by the shape-retaining wires 5, 5', the introducing operation of the core element 9 is simple. The spacing between the shafts 13 and 14 may be adjusted, and the re-connected body may be stretched by tension similar to that on the paper-making machine. During this reconnection, the flap portion 80 of the batt layer 8 represents an extra portion relative to the opposed batt end 81 as shown in FIG. 6. This extra portion of the flap portion 80 including the opposed batt end 81 are finally cut or skived in such a manner as to form the abutting portions at 10 (FIG. 7) which are at right angles to the longitudinal direction and obliquely to the thickness direction. The extra portion of the flap portion 80 is particularly important in securing the intimate contact of the abutting portions 10, so that when skived obliquely, the end portions meet without any clearance space between.

In setting the resulting felt 1 on the paper-making machine, the seaming loops 3, 4 are brought into interdigitated engagement with each other, and for facilitating the introduction of the core element 9, connecting means 15, 15' such as fasteners may be sewn on the upper surface of the batt layer or on the lower surface of the base fabric in registry with the abutting portion 10 as shown in FIG. 7. In this case, if the sewing position is set internally of the abutting ends as shown so that when the connecting means 15, 15' are coupled, the abutting ends are firmly drawn to each other, and the engagement between the seaming loops 3, 4 may be carried out simply to form a common bight for the core element 9.

It is to be noted that the connecting means 15, 15' need be removed when the seaming loops 3, 4 are brought into engagement with each other and the pintle 9 is introduced to complete seaming. Thus, it is preferable that the sewn portion may be removed readily.

In the above-described embodiment, the endlessly formed felt 1 is formed into a flat felt by pulling out the core element 9 introduced into the common bight of the loops 3, 4 thus facilitating the installing of the felt between the rollers of the paper machine. In this installing operation, it is necessary to direct the flap rearwardly of the travelling direction so that the flap is not peeled off when the former passes through a suction box during the travelling of the flap. After the felt is secured in place in the paper-making machine, the flap portion 80 can be subjected to needling by use of a hand-type needling machine (not shown) or can be secured to the base fabric by the adhesives.

EFFECTS OF THE INVENTION

As will be understood from the above-described structure, the present invention is characterized by providing seaming loops on opposite longitudinal ends of a base fabric; confronting the seaming loops in longitudinally spaced-apart relation with shape-retaining wires inserted into bights thereof and needling batt layer(s) on one or both sides of the fabric with or without previously temporarily connecting the confronted portion by means of a suitable connecting member; cutting the batt layer widthwise at one end of the fabric into a flat form; removing the shape-retaining wires from the bight at the opposite ends of the seaming loops to bring the loops into interdigitated and mutually-aligned engagement with each other; introducing a core element into the common bight produced by the alignment thereof to reconnect them; and finally cutting the batt layer so that the ends thereof may abut each other at right angles to the longitudinal direction and obliquely to the thickness direction. Therefore, when connecting the loops to assemble an endless felt on the paper-making machine, the abutting ends of the batt layer are completely brought into close contact with each other, thus eliminating any space between the connected portion during the machine operation, and avoiding making any seam mark on the wet paper. Furthermore, the batt layer along the line of abutment may be needled to integrate the fibrous material of the batt layer in one end with the batt layer of the abutting end.

In addition, since the batt layer covering the connecting portions and other batt layers are formed under the same condition, there is no difference therebetween in density, compression elasticity, air-permeability and water-squeezing properties. The present invention has various other excellent effects.

I claim:

1. A method for producing papermaker's felt having an elongated base fabric, at least one batt layer, and means to interconnect the opposite longitudinal ends of the base fabric to make an endless felt, the method comprising: providing seaming loops having bights on opposite longitudinal ends of the base fabric; positioning said seaming loops in longitudinally spaced-apart relationship and inserting shape-retaining wires into the bights of said loops; and needling a batt layer on at least one side of the fabric and between said spaced-apart loops to make the batt layer endless; cutting said batt layer widthwise adjacent the loops of the fabric into flat form; removing the shape-retaining wires from the bights of the seaming loops at the opposite ends; bringing the loops into interdigitated engagement; introducing a core element into the common bight of said loops produced by said interdigitated engagement to reconnect them; and finally cutting the batt layer so that the ends thereof abut each other at right angles to the longitudinal direction and obliquely to the thickness direction along a line of abutment.

2. The method for producing papermaker's felt as set forth in claim 1, including the steps of providing said batt layer in the form of a fibrous batt previously laminated onto a fabric by needling, and disposing said batt layer flush against said base fabric prior to needling said batt layer on said fabric.

3. The method for producing papermaker's felt as set forth in claim 1 including the step of temporarily connecting said loops in said spaced-apart relation by a connecting member extending between the loops.

4. The method of claim 3 wherein said connecting member is a string-like member and is stretched between said spaced-apart loops in zig-zag form.

5. The method of claim 3 wherein said connecting member is a sheet-like element and is stitched to said shape-retaining members in said spaced-apart loops.

6. The method for producing papermaker's felt as set forth in claim 1 including the steps of disposing the end portions of said batt layer between said spaced-apart loops, and needling the batt layer starting at one of said end portions thereof.

7. A method according to claim 1 including the step of temporarily stitching a connector to each end of said base fabric prior to mounting said felt on a paper making machine, using said connector to interdigitate said loops on the paper making machine for introduction of the core element therethrough, removing the connectors, and needling the batt layer along said line of abutment to integrate the fibrous material of the batt layer in one end with the batt layer of the abutting end.

* * * * *